US006460972B1

(12) United States Patent
Trauernicht et al.

(10) Patent No.: US 6,460,972 B1
(45) Date of Patent: Oct. 8, 2002

(54) THERMAL ACTUATOR DROP-ON-DEMAND APPARATUS AND METHOD FOR HIGH FREQUENCY

(75) Inventors: David P. Trauernicht, Rochester; John A. Lebens, Rush, both of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/993,150

(22) Filed: Nov. 6, 2001

(51) Int. Cl.[7] ..... B41J 2/04; B41J 2/05
(52) U.S. Cl. ..... 347/54; 347/65; 347/56
(58) Field of Search ..... 347/10, 11, 15, 347/54, 68, 70, 20

(56) References Cited

U.S. PATENT DOCUMENTS

| | | | | |
|---|---|---|---|---|
| 3,747,120 A | * | 7/1973 | Stemme | 347/70 |
| 3,946,398 A | * | 3/1976 | Kyser et al. | 347/70 |
| 4,296,421 A | | 10/1981 | Hara et al. | 347/48 |
| 4,513,299 A | | 4/1985 | Lee et al. | 347/15 |
| 4,577,201 A | | 3/1986 | Murakami et al. | 347/68 |
| 5,170,177 A | | 12/1992 | Stanley et al. | 347/11 |
| 5,202,659 A | | 4/1993 | DeBonte et al. | 347/11 |
| 5,361,084 A | | 11/1994 | Paton et al. | 347/15 |
| 5,599,695 A | | 2/1997 | Pease et al. | 435/91.1 |
| 5,689,291 A | | 11/1997 | Tence et al. | 347/10 |
| 5,771,882 A | | 6/1998 | Psaros et al. | 128/203.12 |
| 5,801,732 A | | 9/1998 | Pengelly | 347/70 |
| 5,902,648 A | | 5/1999 | Naka et al. | 42/558 |
| 6,067,797 A | | 5/2000 | Silverbrook | 60/528 |
| 6,102,512 A | | 8/2000 | Torii et al. | 347/10 |
| 6,239,821 B1 | | 5/2001 | Silverbrook | 347/54 |
| 6,534,609 | | 5/2001 | Silverbrook | 347/54 |
| 6,254,793 B1 | | 7/2001 | Silverbrook | 216/27 |
| 6,274,056 B1 | | 8/2001 | Silverbrook | 216/27 |

FOREIGN PATENT DOCUMENTS

| | | | |
|---|---|---|---|
| JP | 20-30543 | 1/1990 | B41J/2/045 |

* cited by examiner

*Primary Examiner*—John Barlow
*Assistant Examiner*—Juanita Stephen
(74) *Attorney, Agent, or Firm*—Milton S. Sales

(57) ABSTRACT

A liquid drop emitter, such as an ink jet device, for emitting a series of liquid drops at high frequency is disclosed. The drop emitter comprises a liquid-filled chamber having a nozzle, a thermo-mechanical actuator for applying pressure to liquid at the nozzle, means for heating the thermo-mechanical actuator in response to electrical pulses, and a controller for determining the parameters of the electrical pulses. The method of operating comprises determining a nominal electrical pulse having a nominal energy $E_0$, a nominal pulse duration $T_{P0}$, which causes the emission of at least one drop at a sustained period of repetition $T_C$. The method of operating further determines a steady state electrical pulse having energy $E_0$, a steady state pulse duration $T_{Pss}$, which, when applied to the electroresistive means does not cause the emission or weeping of the liquid from the nozzle. The method applies to the means for heating, during every period of time $T_C$, a nominal electrical pulse to emit at least one drop, or a steady state electrical pulse, so that an average power $P_{AVE}$, where $P_{AVE}=E_0/T_C$, is applied to the liquid drop emitter in order to maintain a steady state thermal condition.

21 Claims, 13 Drawing Sheets

THERMAL ACTUATOR DROP-ON-DEMAND APPARATUS AND METHOD FOR HIGH FREQUENCY

FIELD OF THE INVENTION

The present invention relates generally to drop-on-demand liquid emission devices, and, more particularly, to ink jet devices which employ thermo-mechanical actuators.

BACKGROUND OF THE INVENTION

Drop-on-demand (DOD) liquid emission devices have been known as ink printing devices in inkjet printing systems for many years. Early devices were based on piezoelectric actuators such as are disclosed by Kyser et al., in U.S. Pat. No. 3,946,398 and Stemme in U.S. Pat. No. 3,747,120. A currently popular form of ink jet printing, thermal ink jet (or "bubble jet"), uses electroresistive heaters to generate vapor bubbles which cause drop emission, as is discussed by Hara et al., in U.S. Pat. No. 4,296,421.

Electroresistive heater actuators have manufacturing cost advantages over piezoelectric actuators because they can be fabricated using well developed microelectronic processes. On the other hand, the thermal ink jet drop ejection mechanism requires the ink to have a vaporizable component, and locally raises ink temperatures well above the boiling point of this component. This temperature exposure places severe limits on the formulation of inks and other liquids that may be reliably emitted by thermal ink jet devices. Piezoelectrically actuated devices do not impose such severe limitations on the liquids that can be jetted because the liquid is mechanically pressurized.

The availability, cost, and technical performance improvements that have been realized by ink jet device suppliers have also engendered interest in the devices for other applications requiring micro-metering of liquids. These new applications include dispensing specialized chemicals for micro analytic chemistry as disclosed by Pease et al., in U.S. Pat. No. 5,599,695; dispensing coating materials for electronic device manufacturing as disclosed by Naka et al., in U.S. Pat. No. 5,902,648; and for dispensing microdrops for medical inhalation therapy as disclosed by Psaros et al., in U.S. Pat. No. 5,771,882. Devices and methods capable of emitting, on demand, micron-sized drops of a broad range of liquids are needed for highest quality image printing, but also for emerging applications where liquid dispensing requires monodispersion of ultra small drops, accurate placement and timing, and minute increments.

A low cost approach to micro drop emission is needed which can be used with a broad range of liquid formulations. Apparatus and methods are needed which combines the advantages of microelectronic fabrication used for thermal ink jet with the liquid composition latitude available to piezoelectromechanical devices.

A DOD ink jet device which uses a thermo-mechanical actuator was disclosed by T. Kitahara in JP 20-30543, filed Jul. 21, 1988. The actuator is configured as a bi-layer cantilever moveable within an ink jet chamber. The beam is heated by a resistor causing it to bend due to a mismatch in thermal expansion of the layers. The free end of the beam moves to pressurize the ink at the nozzle causing drop emission. Recently, disclosures of a similar thermo-mechanical DOD ink jet configuration have been made by K. Silverbrook in U.S. Pat. Nos. 6,067,797; 6,234,609; and 6,239,821. Methods of manufacturing thermo-mechanical ink jet devices using microelectronic processes have been disclosed by K. Silverbrook in U.S. Pat. Nos. 6,254,793 and 6,274,056.

DOD ink jet devices using buckling mode thermo-mechanical actuators are disclosed by Matoba et al., in U.S. Pat. No. 5,684,519, and by Abe et al., in U.S. Pat. No. 5,825,383. In these disclosed devices a thermo-mechanical plate, forming a portion of a wall of the ink chamber, is caused to buckle inward when heated, ejecting drops.

Thermo-mechanical actuator drop emitters are promising as low cost devices which can be mass produced using microelectronic materials and equipment and which allow operation with liquids that would be unreliable in a thermal ink jet device. However, operation of thermal actuator style drop emitters, at high drop repetition frequencies, requires careful attention to excess heat build-up. The drop generation event relies on creating a pressure impulse in the liquid at the nozzle. A significant variation in baseline temperature of the emitter device, and, especially, of the thermo-mechanical actuator itself, causes erratic drop emission including drops of widely varying volume and velocity.

Temperature control techniques are known in thermal ink jet systems which use non-drop emitting electrical pulses to maintain a temperature set-point for some element of the thermal ink jet device. Bohorquez et al., in U.S. Pat. No. 5,736,995, discloses a method for operating a thermal ink jet device having a temperature sensor on the same substrate as the bubble-forming heater resistors. Non-printing electrical pulses are applied as needed to the heater resistors, during clock periods when drops are not being commanded, to maintain the substrate temperature at a set-point.

K. Yeung in U.S. Pat. No. 5,168,284 discloses an open loop method for maintaining a constant printhead temperature in a thermal ink jet printhead. Non-printing pulses, having reduced energy with respect to printing pulses, are applied to the heater resistors during all clock periods when print drops are not commanded.

The known temperature control approaches which have been developed and disclosed for thermal ink jet devices are not sufficient for operating a thermo-mechanical actuator drop emitter at high frequencies. The known approaches do not account for the highly complex thermal effects caused by the various heat flows within and away from the thermo-mechanical actuator when pulsed in response to a typical DOD data stream. Drop repetition rates must be severely limited if the thermal history of the thermo-mechanical actuator is not stabilized.

Thermo-mechanical DOD emitters are needed which manage the thermal condition and profiles of device elements so as to maximize the productivity of such devices. The inventors of the present invention have discovered that uniform DOD emission can be achieved at greatly improved frequencies by operating the thermal actuator with particular attention to the steady state flow of heat energy into the actuator, drop emitter device, and overall drop emission apparatus. This approach is unlike prior art thermal ink jet systems which are managed via device substrate temperature control. It is difficult to predict the residual position of a thermal actuator, especially in the case of a large array of thermal actuators, from a measurement of temperature at some other location in the drop emitter device.

SUMMARY OF THE INVENTION

It is therefore an object of the present invention to provide a liquid drop emitter which is actuated by a thermo-mechanical means.

It is also an object of the present invention to provide a thermo-mechanical drop emitter to produce series and groups of drops having substantially equal volume and velocity.

It is further an object of the present invention to provide a thermo-mechanical drop emitter by maintaining a constant input energy thereby creating a stable thermal condition in the thermo-mechanical actuator, drop emitter device and apparatus, and enabling operation of the emitter in a drop-on-demand fashion at high frequency.

The foregoing and numerous other features, objects and advantages of the present invention will become readily apparent upon a review of the detailed description, claims and drawings set forth herein. These features, objects and advantages are accomplished by providing a liquid drop emitter for emitting a series of liquid drops having substantially uniform volume and velocity, wherein the drop emitter comprises a liquid-filled chamber having a nozzle and a thermal actuator for applying pressure to liquid at the nozzle. The thermal actuator further comprises electroresistive heater means that suddenly heat the thermal actuator in response to electrical pulses. The sudden heating causes bending of the thermal actuator and pressurization of the liquid at the nozzle sufficient to cause drop ejection. A source of electrical pulses is connected to the liquid drop emitter and a controller means receives commands to emit drops and determines the timing and parameters of the electrical pulses which are applied to the liquid drop emitter. The method of operating comprises the determining a nominal electrical pulse having a nominal energy, $E_0$, and a nominal pulse duration, $T_{P0}$, wherein said nominal electrical pulse, when applied to the electroresistive means with a repetition period of $T_C$, causes the emission of a drop having a predetermined volume and velocity. The method also comprises determining a steady state electrical pulse having energy $E_0$, and a steady state pulse duration $T_{PSS}$, wherein said steady state electrical pulse, when applied to the electroresistive means, does not cause the emission or weeping of the liquid from the nozzle. The method further comprises applying to the electroresistive means during every period of time $T_C$, a nominal electrical pulse to emit a drop, or a steady state electrical pulse, so that an average power $P_{AVE}$, where $P_{AVE}=E_0/T_C$, is applied to the liquid drop emitter in order to maintain a steady state thermal condition. The application of steady state electrical pulses may also be suspended to save energy or initiated at system start up based on a determination of the time required to reach a steady state thermal condition and a known master sequence of drop emission commands.

The present invention is particularly useful for liquid drop emitters for DOD ink jet printing. In this embodiment, image data is presented in highly varying clusters and series of drop print commands. The present invention allows a thermo-mechanical actuated ink jet device to accommodate these patterns at high net drop emission frequency.

DETAILED DESCRIPTION OF THE INVENTION

The invention has been described in detail with particular reference to certain preferred embodiments thereof, but it will be understood that variations and modifications can be effected within the spirit and scope of the invention.

As described in detail herein below, the present invention provides apparatus for and methods of operating a drop-on-demand liquid emission device. The most familiar of such devices are used as printheads in ink jet printing systems. Many other applications are emerging which make use of devices similar to ink jet printheads, however which emit liquids other than inks that need to be finely metered and deposited with high spatial precision. The terms ink jet and liquid drop emitter will be used herein interchangeably. The inventions described below provide apparatus and methods for operating drop emitters based on thermo-mechanical actuators so as to improve energy efficiency and overall drop emission productivity.

Figure 1:
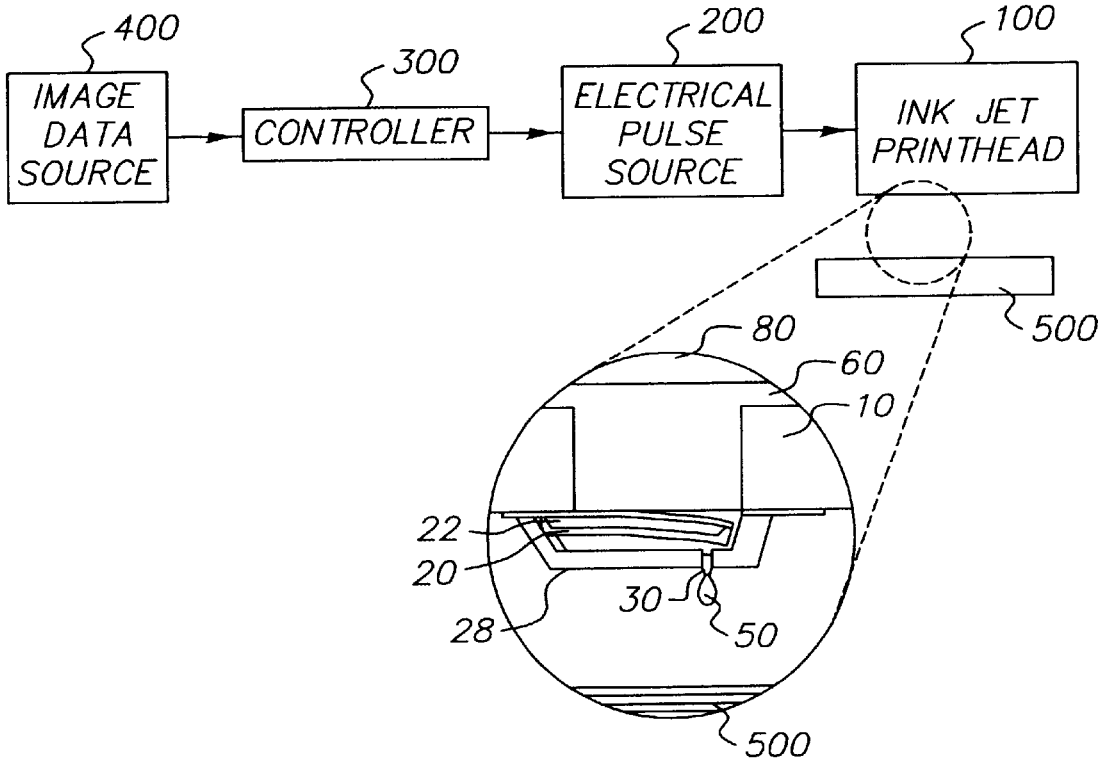
FIG. 1 is a schematic illustration of an ink jet system according to the present invention.

Turning first to FIG. 1, there is shown a schematic representation of an ink jet printing system which may be operated according to the present invention. The system includes an image data source 400 that provides signals that are received by controller 300 as commands to print drops. Controller 300 in turn makes determinations and calculations to be described in following paragraphs. Controller 300 outputs signals to a source of electrical pulses 200. Pulse source 200, in turn, generates an electrical voltage signal composed of electrical energy pulses which are applied to electroresistive means associated with each thermo-mechanical actuator 20 within ink jet printhead 100. The electrical energy pulses cause a thermo-mechanical actuator 20 (hereinafter also "thermal actuator") to rapidly bend, pressurizing ink 60 located at nozzle 30, and emitting an ink drop 50. The present invention causes the emission of drops having substantially the same volume and velocity. That is, having volume and velocity within +/−20% of a nominal value. Some drop emitters may emit a main drop and very small trailing drops, termed satellite drops. The present invention assumes that such satellite drops are considered part of the main drop emitted in serving the overall application purpose, e.g., for printing an image pixel or for micro dispensing an increment of fluid.

Figure 2:
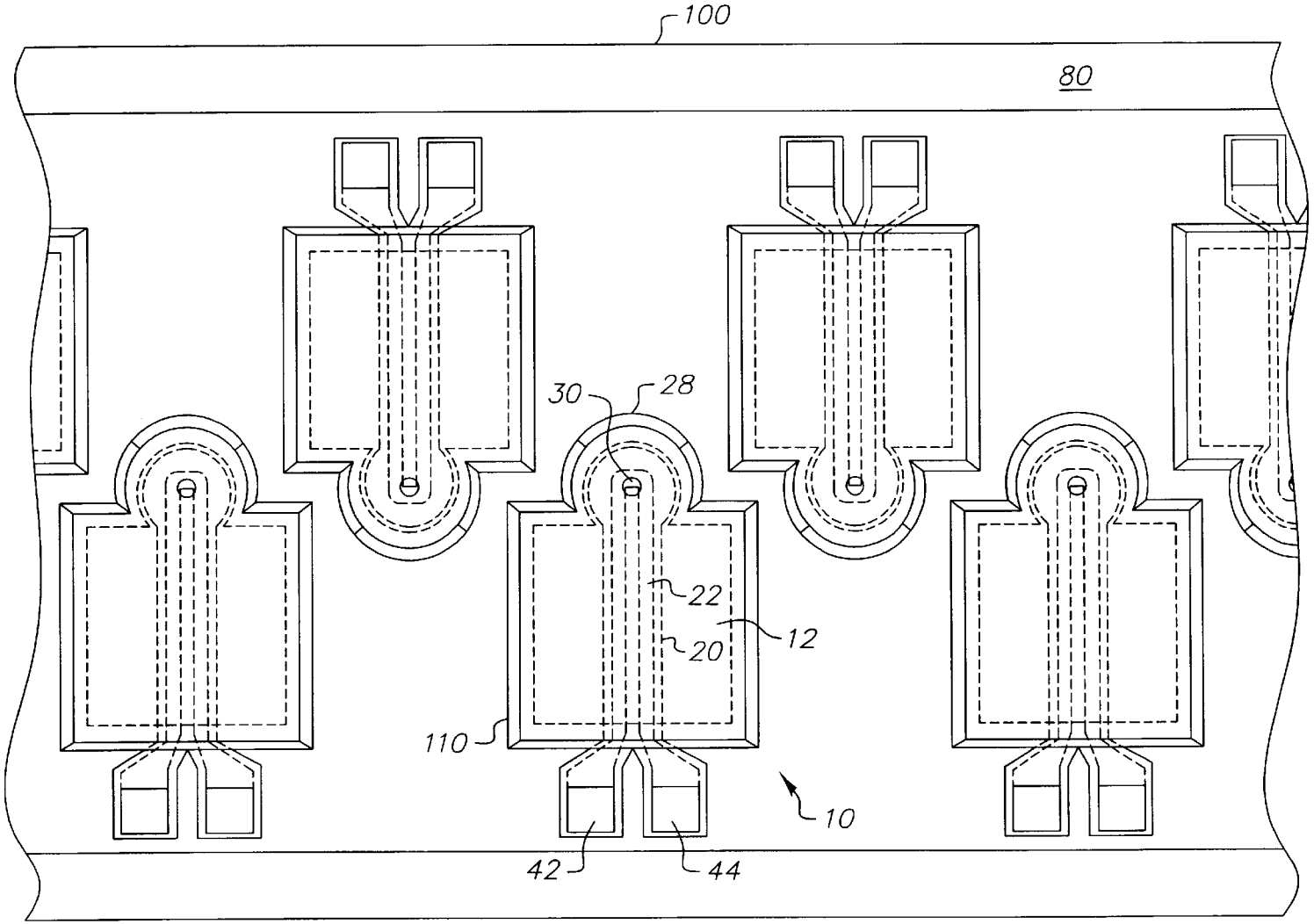
FIG. 2 is a plan view of an array of ink jet units or liquid drop emitter units according to the present invention.

FIG. 2 shows a plan view of a portion of ink jet printhead 100. An array of thermally actuated ink jet units 110 is shown having nozzles 30 centrally aligned, and ink chambers 12, interdigitated in two rows. The ink jet units 110 are formed on and in a substrate 10 using microelectronic fabrication methods. An example fabrication sequence which may be used to form drop emitters 110 is described in co-pending application Ser. No. 09/726,945 filed Nov. 30, 2000, for "Thermal Actuator", assigned to the assignee of the present invention.

Figure 3A:
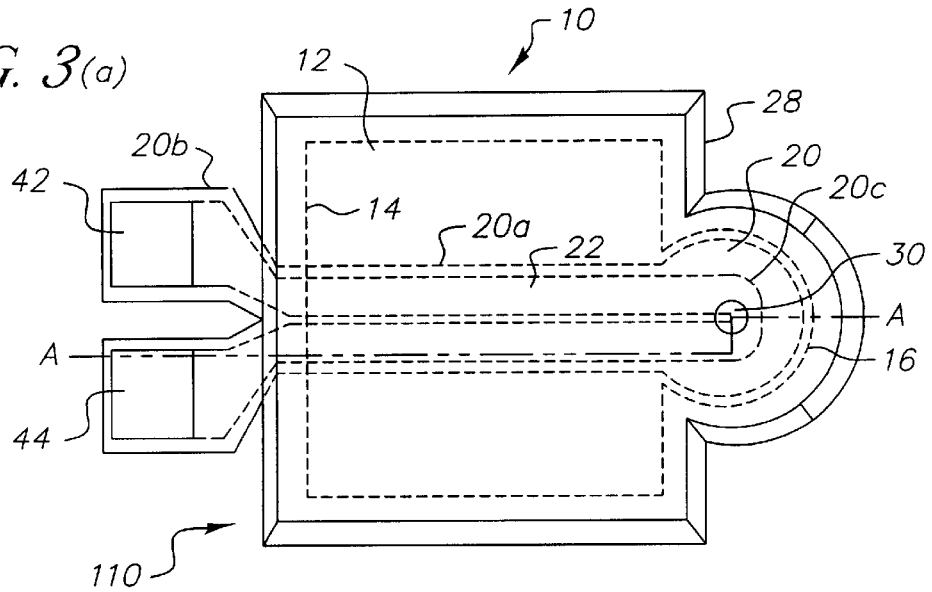
FIGS. 3A and 3B is an enlarged plan view of an individual ink jet unit shown in FIG. 2.

Each drop emitter unit 110 has associated electrical lead contacts 42, 44 which are formed with, or are electrically connected to, a u-shaped electroresistive heater 22, shown in phantom view in FIG. 2. In the illustrated embodiment, the resistor 22 is formed in a layer of the thermal actuator 20 and participates in the thermo-mechanical effects that will be described. Element 80 of the printhead 100 is a mounting structure which provides a mounting surface for microelectronic substrate 10 and other means for interconnecting the liquid supply, electrical signals, and mechanical interface features. FIGS. 3*a* illustrates a plan view of a single drop emitter unit 110 and a second plan view FIG. 3*b* with the liquid chamber cover 28, including nozzle 30, removed.

Figure 3B:
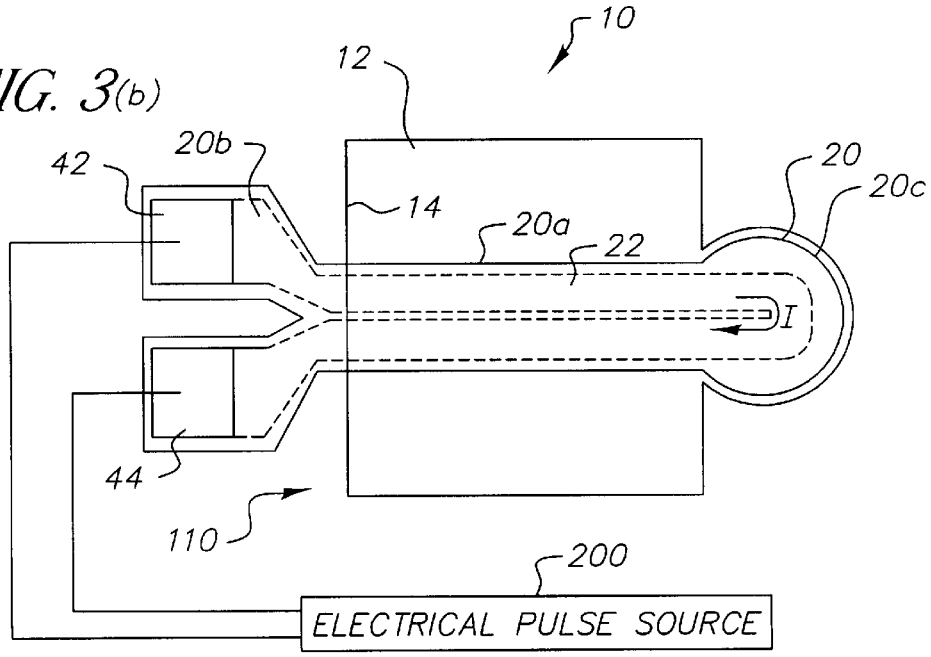

The thermal actuator 20, shown in phantom in FIG. 3*a* can be seen with solid lines in FIG. 3*b*. The cantilevered portion 20*a* of thermal actuator 20 extends from edge 14 of liquid chamber 12 that is formed in substrate 10. Actuator portion 20b is bonded to substrate 10 and anchors the cantilever.

The cantilever portion 20*a* of the actuator has the shape of a paddle, an extended flat shaft ending with a disc 20*c* of larger diameter than the shaft width. This shape is merely illustrative of cantilever actuators that can be used, many other shapes are applicable. The paddle shape aligns the nozzle 30 with the center of the actuator free end 20*c*. The fluid chamber 12 has a curved wall portion at 16 which conforms to the curvature of the actuator free end 20*c*, spaced away to provide clearance for the actuator movement.

FIG. 3*b* illustrates schematically the attachment of electrical pulse source 200 to the electroresistive heater 22 at interconnect terminals 42 and 44. Voltage differences are applied to voltage terminals 42 and 44 to cause resistance heating via u-shaped resistor 22. This is generally indicated by an arrow showing a current I. In the plan views of FIG. 3, the actuator free end 20*c* moves toward the viewer when pulsed and drops are emitted toward the viewer from the nozzle 30 in cover 28. This geometry of actuation and drop emission is called a "roof shooter" in many ink jet disclosures.

Figure 4:
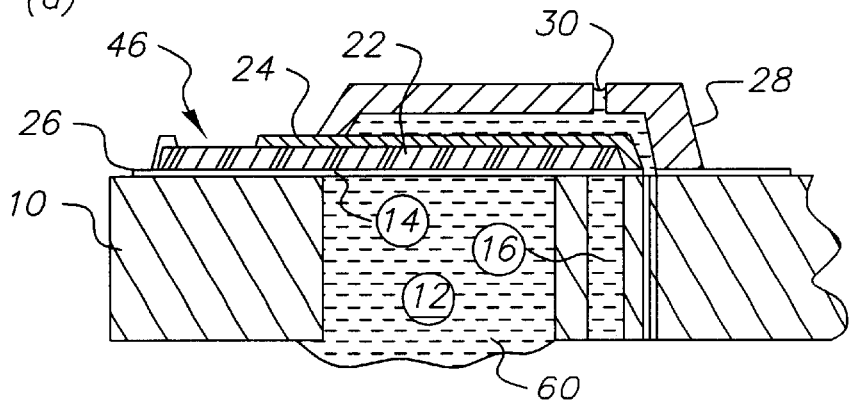
FIGS. 4A, 4B and 4C is a side view of an individual ink jet unit as shown in FIGS. 2 and 3 illustrating the movement of the thermal actuator to emit drops.
Figure 4:
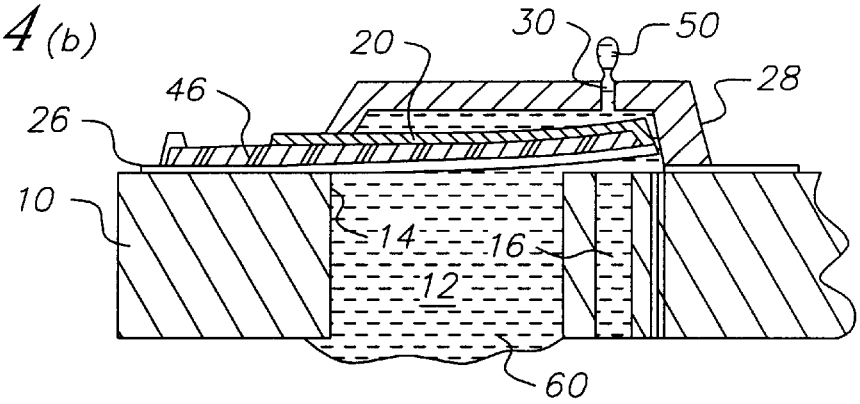
Figure 4:
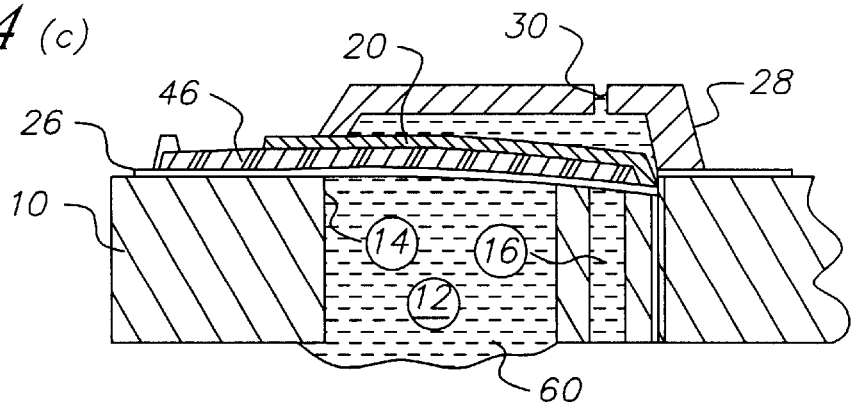

FIG. 4 shows a side view along section A—A of inkjet unit device 110 in FIG. 3. FIG. 4*a* shows the thermal actuator 20 in a quiescent, relaxed state. FIG. 4*b* shows actuator bent in response to thermal heating via resistor 22. FIG. 4*c* shows the actuator recoiled past the relaxed position following cessation of heating and rapid cooling.

In an operating emitter of the cantilever type illustrated, the steady state relaxed position may be a bent position rather than the horizontal position conveyed FIG. 4*a*. The actuator may be bent upward or downward at room temperature because of internal stresses that remain after one or more microelectronic deposition or curing processes. The device may be operated at an elevated temperature for various purposes, including thermal management design and ink property control. If so, the steady state position may be as substantially bent as is illustrated in FIG. 4*b*. And, it may be that, while being repeatedly actuated, the actuator does not cool completely leaving it relaxed and bent upward.

For the purposes of the description of the present invention herein, the actuator will be said to be "relaxed" when its position is no longer substantially changing, that is it has reached a steady state position. For ease of understanding, the steady state position is depicted as horizontal in FIGS. 4 and 5. However, operation of thermal actuators about a bent steady state position are known and anticipated by the inventors of the present invention and are fully within the scope of the present inventions.

The illustrated actuator 20 is comprised of elements 22, 24 and 26. Resistor 22 is formed from an electroresistive material having a relatively large coefficient of thermal expansion. Overlayer 24 is electrically insulating, chemically inert to the working liquid, and has a smaller coefficient of thermal expansion than has the electroresistive material forming resistor 22. Passivation layer 26 is a thin layer of material that is inert to the working liquid 60 and serves to protect heater resistor 22 from chemical or electrical contact with the working fluid 60.

An electrical pulse applied to heater resistor 22, causes it to rise in temperature and elongate. Overlayer 24 does not elongate as much causing the multilayer actuator 20 to bend upward. For this design, both the difference in thermal expansion coefficients between elements 22 and 24 and a momentary temperature differential, aids in the bending response. The electrical pulse and the bending response must be rapid enough to sufficiently pressurize the liquid at the nozzle 30 indicated generally as 12*c* in FIG. 4*a*. Typically an electrical pulse duration of less than 10 $\mu$secs is used and preferably a duration less than 4 $\mu$secs.

The thermal actuator 20 will relax from the bent position illustrated in FIG. 4*b* as elements 22 and 24 equilibrate in temperature, as heat is transferred to the working fluid and substrate 10, and due to mechanical restoring forces set up in elements 22 and 24. The relaxing thermal actuator 20 may over shoot the steady state position and bend downwards as illustrated in FIG. 4*c*. The actuator 20 may continue to "ring" in a resonant oscillatory motion until damping mechanisms, such as internal friction and working fluid resistance, deplete and convert all residual mechanical energy to heat.

Figure 5A:
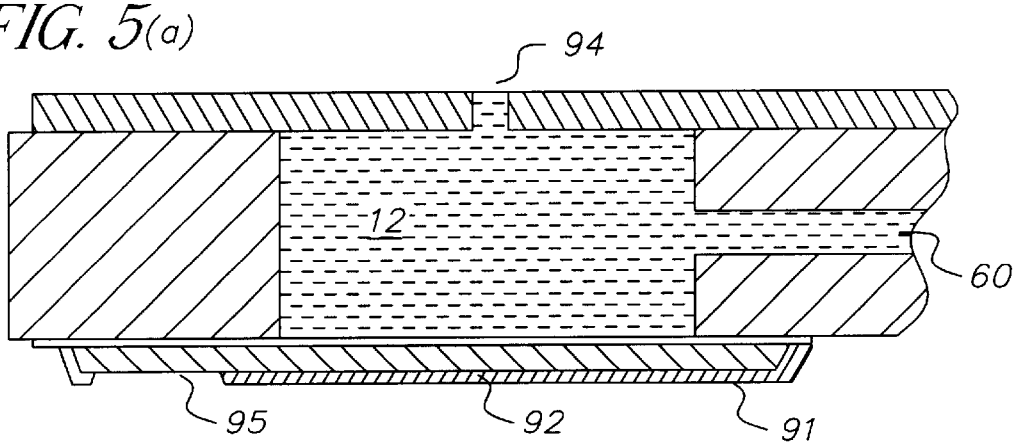
FIGS. 5A and 5B is a side view of an individual ink jet unit having a buckling mode thermal actuator and illustrating the movement of the thermal actuator to emit drops.
Figure 5B:
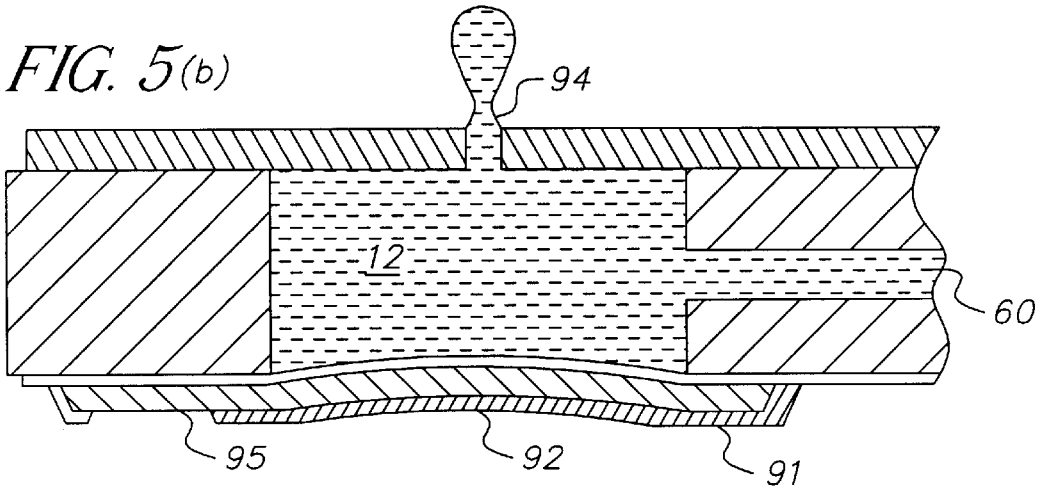

An alternative configuration for the thermo-mechanical actuator is illustrated in FIG. 5. A side view of a drop emitter having a buckling style thermal actuator 90 is shown in relaxed steady state position in FIG. 5*a* and emitting a drop 50 in FIG. 5*b*. The buckling actuator 90 illustrated is constructed using a layered structure similar to the cantilever actuator 20 shown in FIGS. 1–4. Electroresistive layer 95 is heated by electrical pulses causing it to be elongated more than backing layer 92 which has a lower coefficient of thermal expansion than that of electroresistive layer 95. The mismatch in expansion between layers 95 and 92 causes the actuator to bend, or buckle, inward, pressurizing the liquid 60 in chamber 12, and causing the emission of drop 50 from nozzle 94.

The buckling actuator configuration illustrated in FIG. 5 differs from the cantilever actuator in that it is bonded on all edges and forms a portion of a wall of the drop emitter liquid chamber 12. The buckling actuator may also exhibit damped resonant oscillations in the modes of a plate following impulses of electrothermal energy.

Thermo-mechanical actuators transduce thermal energy into mechanical actuation by making use of differing amounts of thermal expansion within the actuator structure. Thermal expansion differences are created by causing portions of the structure to be at different temperatures, using materials having large differences in coefficients of thermal expansion, and combinations of both. Other factors such as geometry, and material properties such as heat capacity, Young's modulus and the like, are also part of the actuator design consideration.

When thermo-mechanical actuators are used as the electromechanical transducer for a drop-on-demand drop emitter, they are operated in an intermittent fashion. That is, the thermal actuator is pulsed in a time pattern that follows the drop demand time pattern. For example, in an ink jet drop emitter, the actuator will be pulsed to generate the pattern of image pixels in the image scan line being addressed by the jet it actuates. Heat pulses are applied in bursts for text images, in long strings for heavy ink coverage areas, and in sparse, time-isolated, fashion for grayscale images. Therefore, the thermal history and prevailing temperature differences in portions of the thermal actuator and overall drop emitter device may vary significantly during time periods comparable to the attempted period of drop emission, $T_C$.

Management of thermal effects arising from the highly complex pattern of heat pulsing in a DOD emitter is necessary in order to operate such devices at the highest possible drop repetition frequencies. In particular, in order to emit drops having uniform volume and velocity, it is important to operate the thermal actuator so as to generate an equivalent pressure pulse for each drop emission, in the face of the complex thermal history effects being created.

The inventors of the present invention have discovered that uniform DOD emission can be achieved at greatly improved frequencies by operating the thermal actuator with particular attention to the steady state flow of heat energy into the actuator, drop emitter device, and overall drop emission apparatus. Unlike prior art thermal ink jet systems that are managed via device substrate temperature control, a thermo-mechanical actuator drop emitter is sensitive to temperature difference within the actuator and surrounding structures and materials. These temperature differences change over time due to complex patterns of heat flows through materials having differing heat capacity, thermal conductivity, thickness, interface characteristics and the like. It is difficult to predict the residual position of a thermal actuator, especially in the case of a large array of thermal actuators, from a measurement of temperature at some other location in the drop emitter device, than the actuator itself.

It has been discovered that controlling the energy flow, the power, to the thermo-mechanical actuators, is a useful thermal management technique for allowing operation of drop emitters at significantly higher frequencies. Essentially this approach creates a baseline of temperatures and heat flow within the device from which each drop emission event may be executed. The energy flow control of the present invention may be used together with other thermal management techniques that control the temperature of one or more components to set-points.

Figure 6:
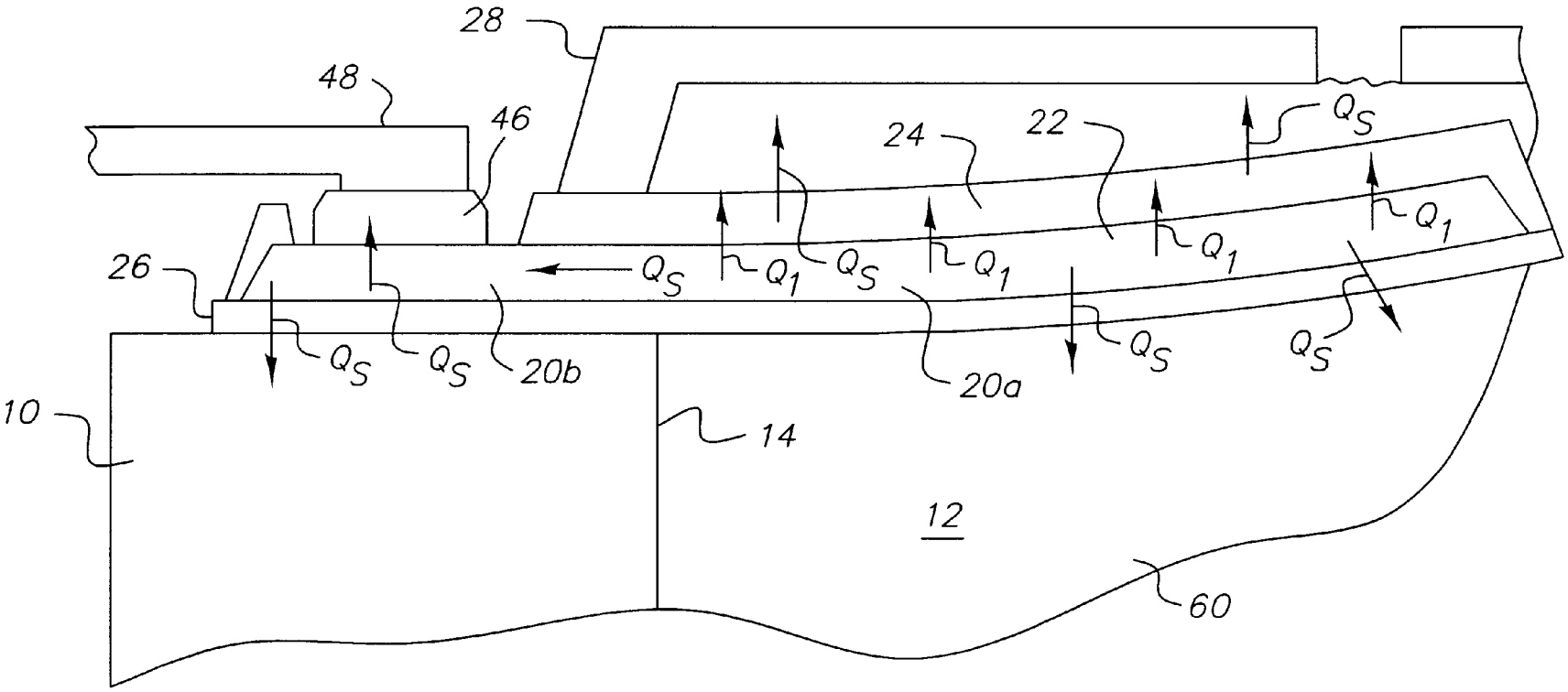
FIG. 6 illustrates an enlarged side view of a cantilever thermal actuator showing heat flows from the electroresistive means.

FIG. 6 illustrates an enlarged view of a cantilever thermal actuator 20 as depicted in FIGS. 1–4. The degree of bending of the depicted actuator depends in part on the differences in thermal expansion coefficients among the three materials making up the cantilever: resistor 22, overlayer 24 and thin passivation layer 26. The bending further depends on the temperatures prevailing both within and among the layers.

If the entire actuator cantilever portion 20*a*, the portion extending into the liquid filled chamber 12 from chamber wall edge 14, has the same temperature throughout, then the amount of bending will be determined by the thermal expansion coefficient mismatches and geometry factors. The thermal actuator will relax as it cools by giving up heat in the form of heat flows, $Q_s$, to the surrounding structures and materials. Various such heat flows are indicated in FIG. 6 by the double line arrows labeled, $Q_S$ Heat flows into the liquid 60, the substrate 10 via the actuator anchor portion 20*b*, into the electrical connection bond 46 and conducting lead 48, and into the chamber cover plate 28, and from these structures onward into other portions of the emitter device, head structure, and apparatus.

Figure 7:
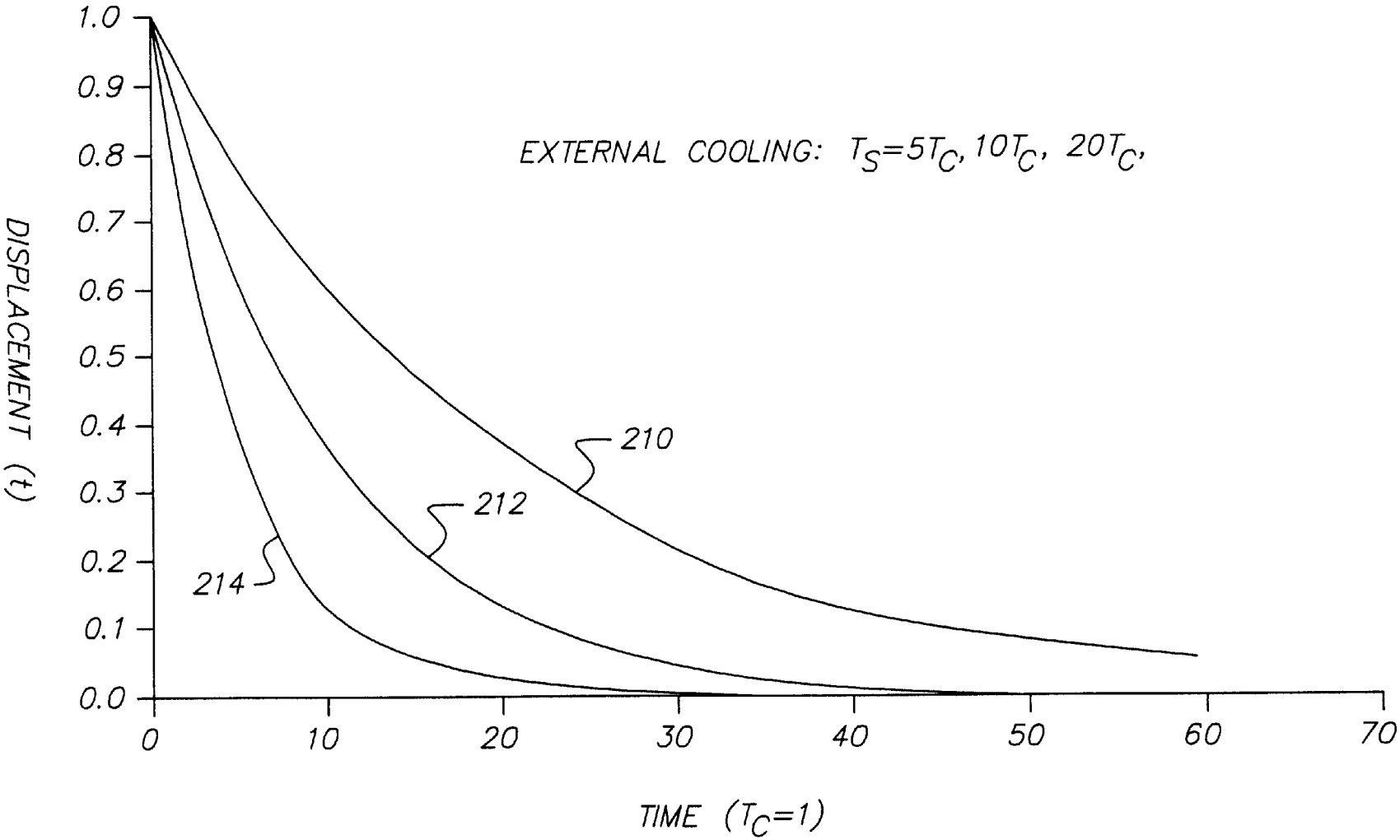
FIG. 7 illustrates the relaxation of a thermal actuator as it cools due to heat flows to other materials and structures of the drop emitter apparatus.

FIG. 7 illustrates the relaxation of a thermal actuator as it cools via heat flow. The well known Newton's law of exponential cooling has been used to model the actuator cooling. Actuator displacement, X(t) is assumed proportion to the temperature differential above ambient. The time axis of FIG. 7 has been plotted in units of $T_C$, the drop emission repetition period. That is, $T_C=1/F_{MAX}$, where $F_{MAX}$ is the maximum frequency at which the emitter is intended to be operated in a drop-on-demand fashion. All of the many heat flow processes that occur are lumped into one net time constant, $T_S$, to describe the thermal actuator-to-system cooling. Such a lump-parameter illustration is sufficient for understanding the present invention. Three values of $T_S$, expressed in units of $T_C$, are plotted $T_S=5T_C$, $10T_C$, and $20T_C$.

It can be seen from FIG. 7 that the illustrated actuator relaxation processes are complete, or have reached practical equilibrium, after a time equal to $5T_S$ to $6T_S$. The thermo-mechanical actuator 20 is considered herein as having reached a steady state thermal condition. For example, if a liquid emitter device is operated at a maximum drop repetition frequency of 20 KHz, $T_C=50$ μsec. If the system cooling time constant is 250 μsec., the plot for $T_S=5T_C$ (curve 214) applies. The actuator would reach thermal steady state after a time ~$30T_C$, or 1.5 msec. in this example.

Since thermal energy is introduced locally into a thermal actuator structure, some amount of the initial bending response is attributable to a substantial temperature differential within the actuator itself. For the actuator configurations illustrated in FIGS. 1–6 it can be realized that the electroresistive layer 22 is the means by which the actuator temperature is raised. It is also the layer having the largest value of coefficient of thermal expansion. The immediate response of the layered actuator of FIG. 6 when pulsed, is for the electroresistive layer 22 to reach the highest temperature of any portion of the structure, extend to a maximum length, and achieve maximum bending. Heat will flow into overlayer 24 that reduces the temperature of the extended layer 22 and also the temperature differential between the layers, causing a quick relaxation of the bending.

Figure 8:
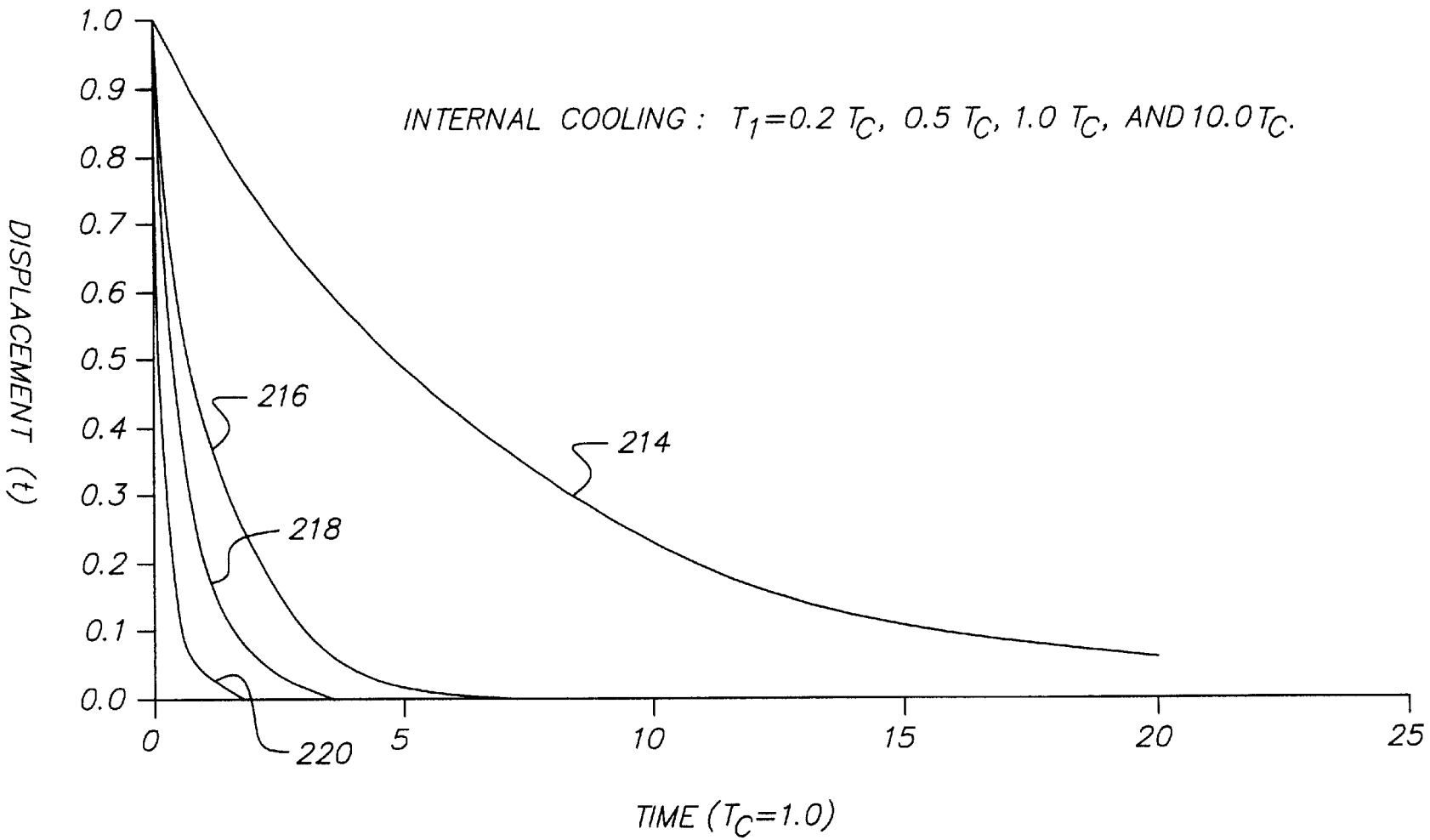
FIG. 8 illustrates the relaxation of a thermal actuator as it reaches internal thermal equilibrium.

The internal thermal actuator heat flow, $Q_I$, is illustrated by arrows so labeled in FIG. 6. The internal thermal equilibrium is reached much more quickly than the steady state thermal condition discussed previously. FIG. 8 illustrates a rapid internal cooling process wherein the internal cooling time constant, $T_I=0.2T_C$, $0.5T_C$, or $1.0T_C$ (curves 216, 218 and 220 respectively). Newton's exponential law of cooling is used to model the temperature and the displacement of the actuator is assumed to be proportional to the temperature above ambient. For ease of comparison, the system cooling plot for $T_S=10T_C$ (curve 212 in FIG. 7) is also plotted. It is necessary for this internal thermal equilibrium process to be rapid, otherwise the overlayer layer 24 would be acting as a block to heat flow out of the extended layer 22 and would prevent the rapid relaxation necessary to shortening $T_C$, i.e., to increasing drop repetition frequency, $F_{MAX}$.

Figure 9:
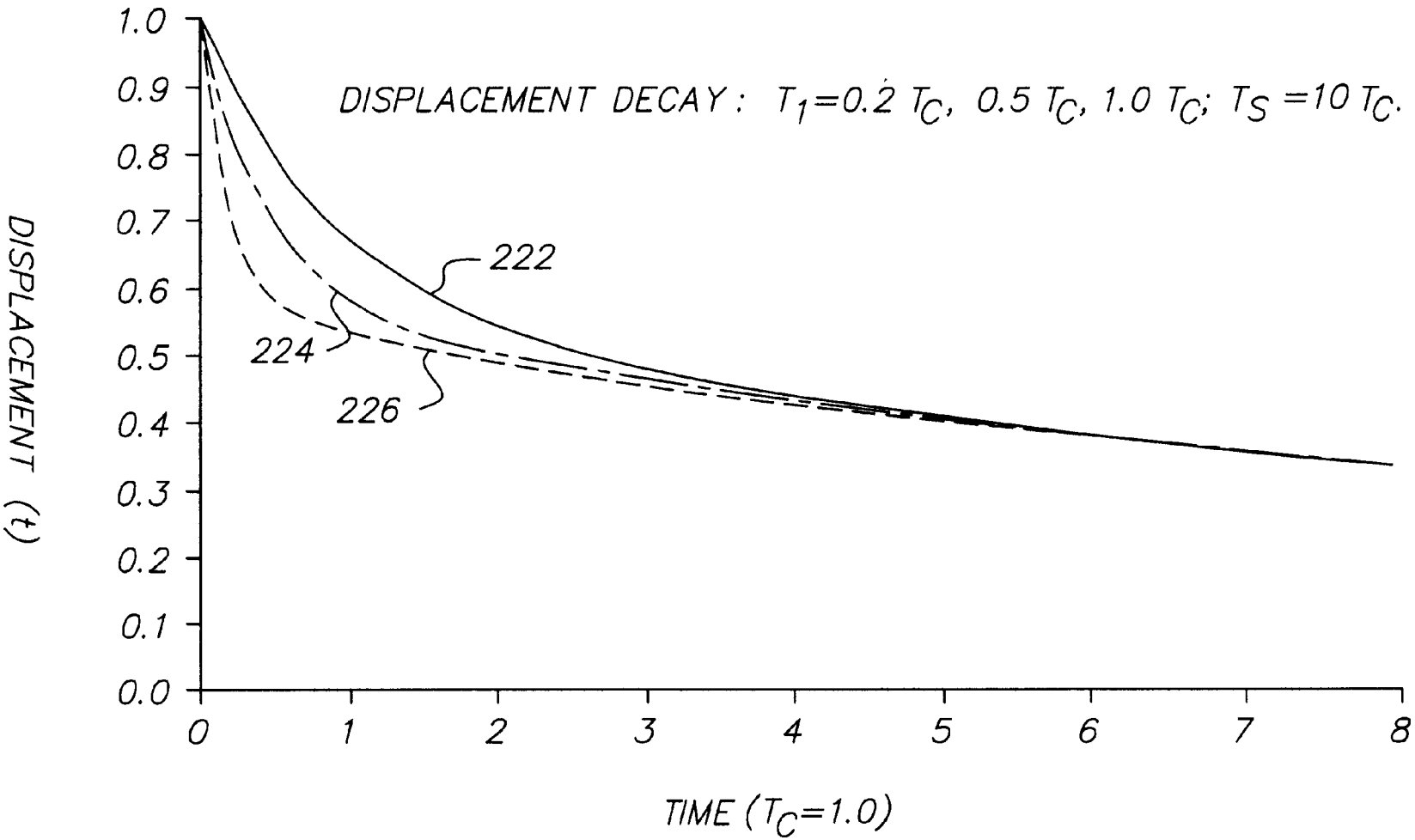
FIG. 9 illustrates the relaxation of a thermal actuator as it cools due to internal and external heat flows combined.
Figure 10:
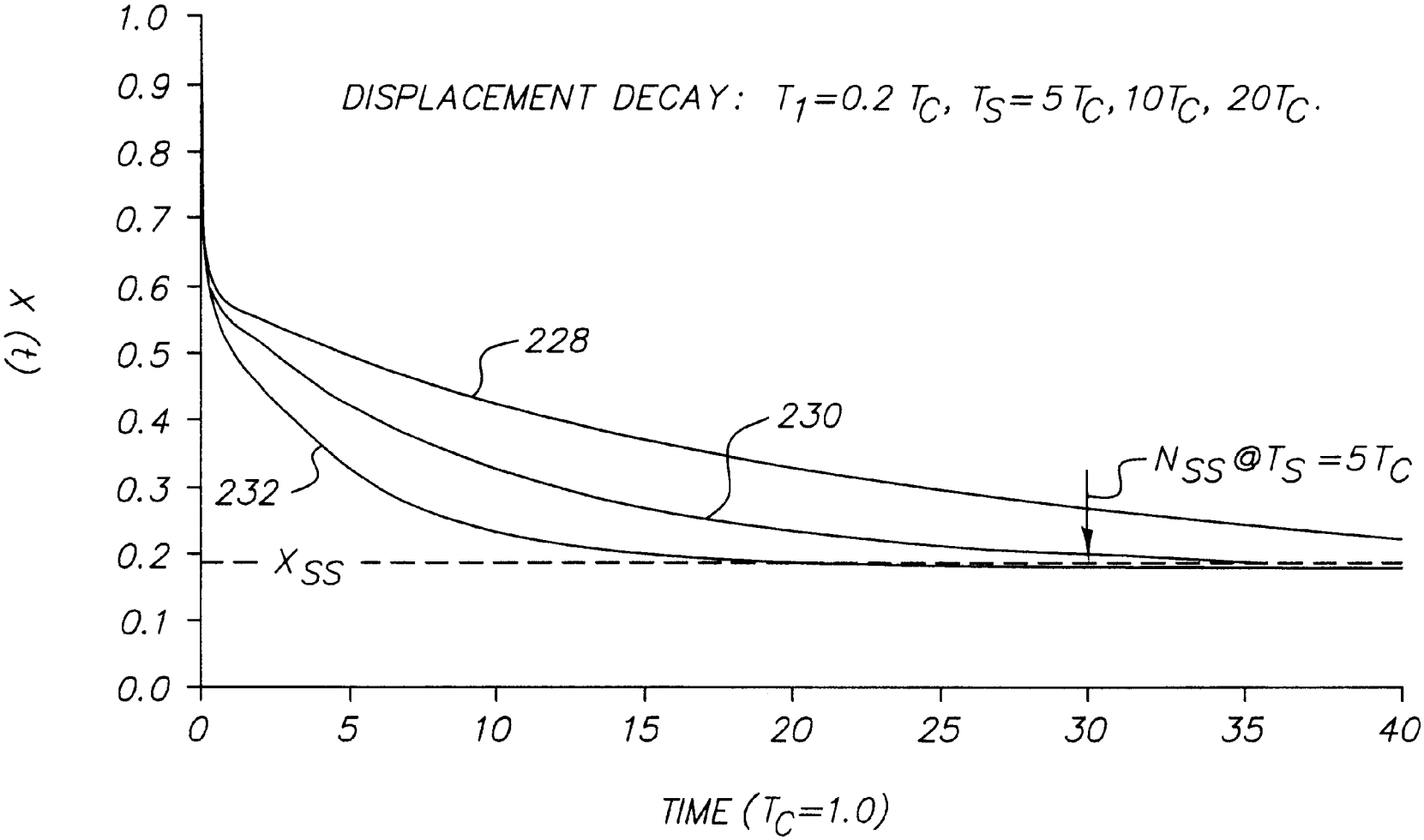
FIG. 10 illustrates the relaxation of a thermal actuator as it cools due to internal and external heat flows combined.

FIG. 9 illustrates the relaxation of a thermo-mechanical actuation wherein both an internal thermal equilibrium governed by a cooling time constant, $T_I$, and a system steady state cooling process of time constant $T_S$, is operating. Three cases are plotted all having $T_S=10T_C$, and with $T_I=0.2T_C$, $0.5T_C$, and $1.0T_C$ (curves 226, 224, and 222 respectively). FIG. 10 shows three cases having the same constant for internal cooling, $T_I=0.2T_C$, and with system cooling time constants $T_S=5T_C$, $10T_C$, and $20T_C$(curves 232, 230 and 228 respectively).

The actuator displacement, X(t), is shown trending to a value at steady state, $X(t_{ss})=0.15$, rather than 0. On the arbitrary units scale of FIGS. 9 and 10, the maximum displacement X(t=0)=1.0 The plots show a steady state offset or bending amounting to about 15% of maximum bending to illustrate the operation of the present invention. According to the present invention, explained hereinbelow, an average power, $P_{AVE}$, is applied to the thermal actuator which results in a steady state actuator temperature elevation above ambient, and a steady state deflection. For the examples of FIGS. 9 and 10, this application of average power uses 15% of the overall actuator deflection potential. As will be explained below, a tradeoff is made of a portion of the deflection potential in order to smooth the complex thermal history effects of drop-on-demand actuation.

It has been discovered by the inventors of the present invention that a thermo-mechanical drop emitter can be operated to produce drops of uniform velocity and volume at much higher repetition frequencies when operated continuously or steadily than when operated intermittently. In one experiment using thermally actuated drop emitters configured as illustrated in FIGS. 2–4, intermittent drop-on-demand operation became erratic at base drop repetition frequencies of 500 Hz. However, the same drop emitters could be operated successfully at 2 KHz when emitting a long steady stream of drops. It was further discovered that the critical factor in the successful high frequency operation was the maintenance of a steady input of electrical pulse energy, whether or not every pulse had the characteristics necessary for drop ejection.

The present invention is based on applying the same amount of energy per drop emission clock period to the thermo-mechanical actuator in two different manners: (1) nominal pulses that cause drop emission, and (2) steady state electrical pulses that have the correct power to maintain a steady state thermal condition.

The present invention establishes a necessary nominal pulse energy and nominal pulse width which will result in emitting drops of substantially uniform and predetermined volume and velocity at the desired, repetition period, $T_C=1/F_{MAX}$, and for a sustained period of time. By sustained period it is meant for a time long enough to serve the intended application of the drop emitter. For example, this might be the time to print a page or 20 pages of images for a carriage based inkjet printer, or for a few seconds for a microdispenser, or indefinitely.

The nominal pulse energy, $E_0$, and pulse width, $T_{P0}$, may be somewhat different from the pulse parameters which product the same drop volume and velocities at very low repetition frequencies. This is because sustained operation sets up a unique thermal profile in the device which is not replicated at low frequencies. Also, the lower limit on the repetition period $T_C$, may be set by thermal cooling limitations if not by fluid refill problems. It may be understood from FIGS. 7–10 that trying to operate at reduced values of $T_C$, requires allowing the steady state deflection to be an ever higher percentage of the total deflection amount. The ultimate maximum deflection is limited by the maximum temperature the device and liquid can tolerate. At some point, one cannot shorten $T_C$, and compensate by increasing the nominal pulse energy and the steady state deflection tolerated, without damaging the drop emitter or working fluid.

Once reliable operation is established ($E_0$, $T_{P0}$) so that drops of the desired volume and velocity are emitted reliably at the repetition period, $T_C$, then an average steady state power, $P_{AVE}$, has also been established, $P_{AVE}=E_0/T_C$. It is then the approach of the present invention to apply this average steady state power, $P_{AVE}$, during every time period, $T_C$. It is not necessary to apply power during times when the emitter is not in use. In general, the present invention applies the steady state power so that the steady state thermal condition is in effect whenever drop emissions are needed by the application. If an application can compromise on drop volume and velocity uniformity, then drop emission might be allowed for a portion of cycle time in which the steady state is being established (start-up) or is decaying (shut-down).

Figure 11:
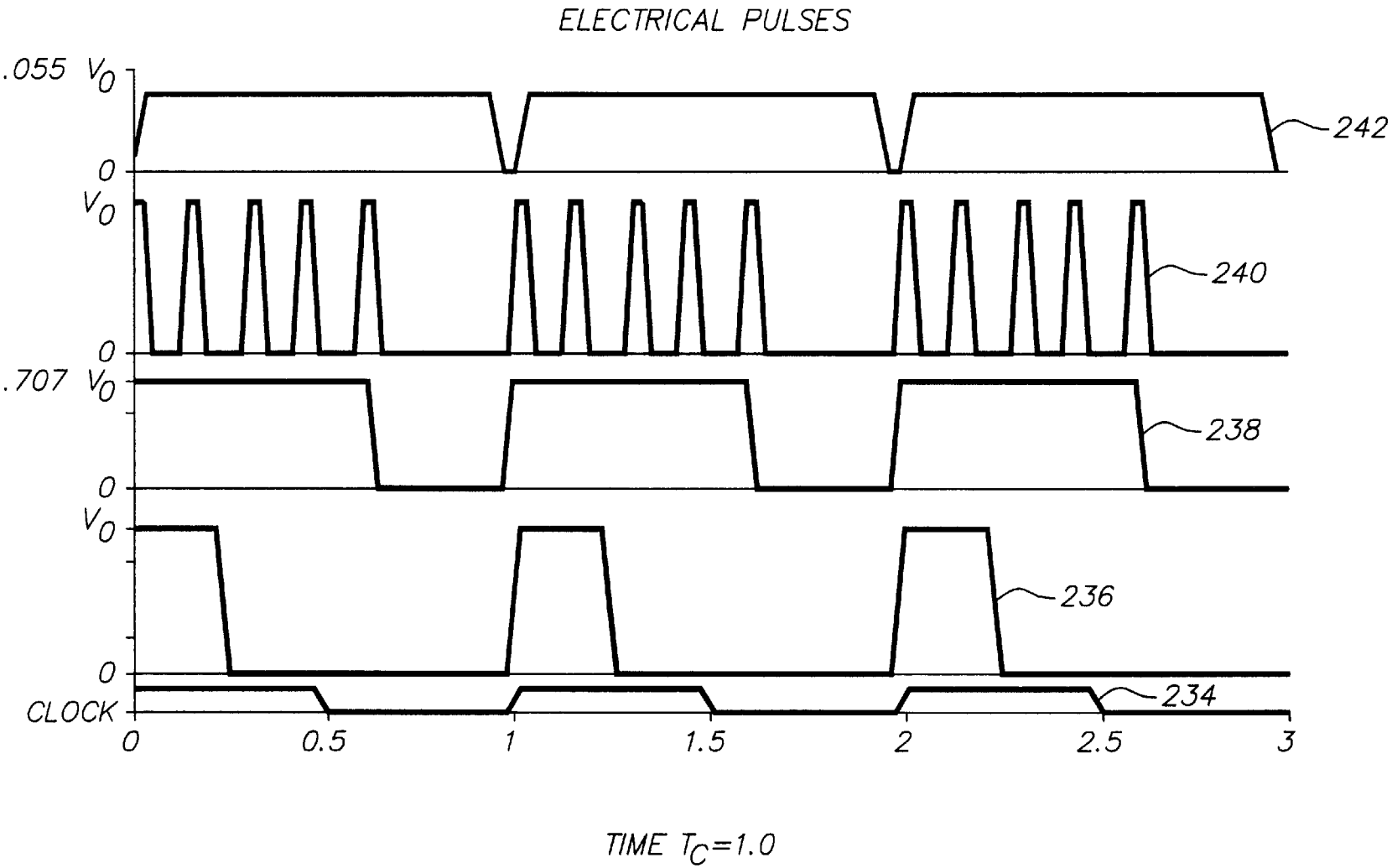
FIG. 11 illustrates electrical pulses and signals that may be used with the present invention.

FIG. 11 illustrates several electrical pulses that are relevant to understanding the present invention. A drop emission clock signal is shown as curve 234, having period, $T_C$, corresponding to the maximum drop repetition frequency. Immediately above the clock signal is a nominal pulse signal 236, having a voltage pulse duration, $T_{P0}=0.3T_C$, and a nominal voltage maximum, $V_0$. Application of such an electrical signal to the electroresistive means of the thermo-mechanical actuator will cause the sustained emission of nominal volume and velocity drops, one per period, $T_C$.

Signals 238, 240, and 242 in FIG. 11 are examples of steady state pulses which apply the same power, $P_{AVE}=E_0/T_C$, to the thermal actuator but do not result in drop emission or nozzle weeping. The steady state electrical pulses do not cause drop emission or weeping because the actuator motion they cause is not sufficiently sudden to generate liquid chamber pressures high enough to overcome nozzle meniscus pressures. It may also be that the short internal cooling process, characterized by $T_I$ (see FIG. 8), effectively reduces the peak deflection achieved by the same energy applied in the shorter time of the nominal pulse, $T_{P0}$.

For thermal actuators of the configuration illustrated in FIGS. 1–6, the nominal pulse duration, $T_{P0}$, should preferably be short compared to the internal cooling time constant, $T_I$, in order to maximize thermo-mechanical efficiency. If the electroresistive means and source of electrical signals can supply energy fast enough, the drop emission can be accomplished by supplying only the heat required to raise the temperature of the electroresistive layer 22, and not waste energy raising the temperature of the overlayer 24. Then, supplying the same energy in a longer pulse will not cause nearly as much deflection because some of the heat will be taken up by the heat capacity of the overlayer 24, reducing the peak temperature reached by the layer 22, the effective extending portion of the actuator.

To most closely mimic the thermal effects of a nominal pulse, steady state pulses can be designed to be just long enough that the deflection is ineffective to cause weeping. For example, this can be experimentally determined by observing drop emitters pulsed at a sustained rate at $F_{MAX}=1T_C$and energy per pulse $E_0$ while gradually decreasing pulse width until the onset of weeping behavior. Example steady state electrical pulse shape 238 in FIG. 11 has width $T_{Pss}=0.6\ T_C$ and voltage $V_{Pss}=0.707\ V_0$. It will cause thermal history effects in the thermal actuator and drop emitter which closely approximate sustained pulsing with nominal pulses.

When the drop emission period, $T_C$, is on the same order as the internal cooling rate, $T_I$, that is when $T_C<5T_I$, then it is most important that a smallest value of the steady state pulse duration be selected. This is because there may be residual thermal history effects within the actuator itself that should preferably be maintained to the extent possible by steady state pulsing. One manner of determining the smallest value of the steady state pulse duration, $T_{Pss}$, is to begin by applying, to the electroresistive means, electrical pulses having energy $E_0$ and period about $T_C$. And then, gradually, decreasing the pulse duration until weeping of liquid at the nozzle is observed. The smallest value of $T_{Pss}$ is then selected to be somewhat larger so as to maintain reliable operation in the face of other system variables that may also affect weeping.

The determination of the smallest value of the steady state pulse duration should preferably be made over a time extended long enough to observe any unreliability arising from intermittent weeping. Other system variables, such as liquid properties, temperature, humidity, nozzle surface contamination, liquid supply pressure variations, electrical component drift and variation, mechanical accelerations, including jarring, and the like, must be accommodated by the choice of the smallest value of the steady state pulse duration. In general, the smallest value of the steady state pulse duration is that which will apply energy, $E_0$, to the thermal actuator without causing any liquid to be discharged from the nozzle, and while the drop emitter is subject to the full variation of relevant parameters in the system.

Steady state pulse waveform 240 in FIG. 11 is composed of short subpulses having, in total, the same energy as a nominal pulse. In this example the subpulses have maximum voltage, $V_0$ equal to the nominal pulse voltage maximum. From a system design viewpoint, it may be less costly to supply steady state power as a series of short pulses having the same voltage source as nominal pulses, rather than a separate maximum voltage requirement. The series of small pulses does not cause drop emission because the stretched out time for total energy application allows the internal actuator heat transfer effects previously discussed to spoil peak actuator acceleration and deflection.

The nearly DC level pulse waveform illustrated as curve 242 is acceptable for some thermal actuator systems, especially wherein the choice of drop repetition period, $T_C$, is much longer than any internal actuator thermal history effects, that is, if $T_C > 5T_I$.

Figure 12:
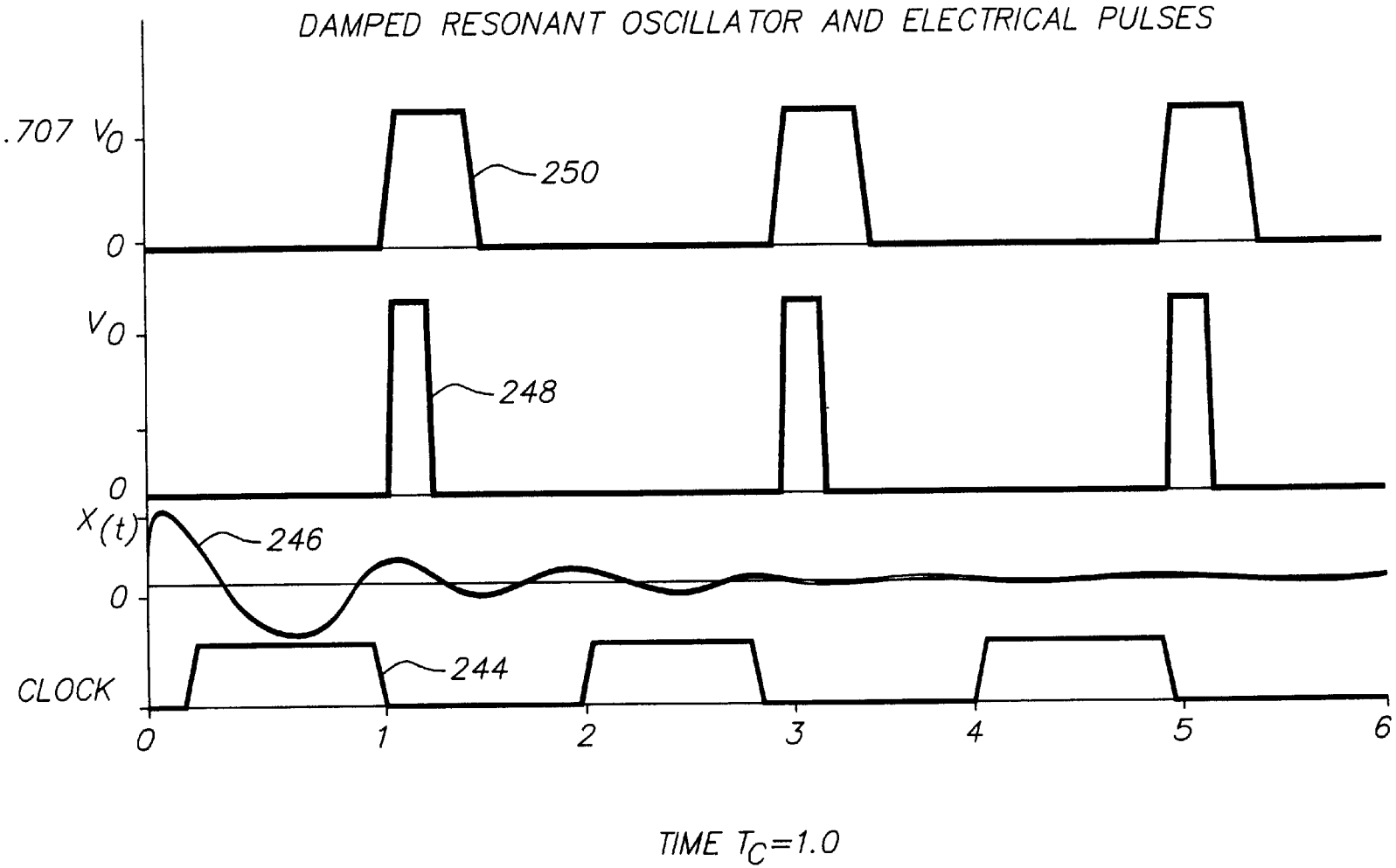
FIG. 12 illustrates electrical pulses and signals that may be used with an embodiment of the present invention.

Cantilevered thermal actuators exhibit damped resonant oscillation with a resonant period, $T_R$ when pulsed. If the drop emission period $T_C$ is chosen to be comparable to this resonant oscillation period, then the use of steady state pulses for thermal management should preferably not overly excite the resonant oscillation. This situation is illustrated in FIG. 12. FIG. 12 shows a damped resonant oscillation 246 representing a cantilever thermal actuator having a fundamental mode resonant period $T_R$. Drop emission clock 244 has been chosen to be equal to twice the resonant frequency $T_C = 2T_R$. An effective nominal pulse 248 is selected to have pulse duration, $T_{P0} < \frac{1}{4}T_R$ to take advantage of the cantilever mechanical response. In this case, the steady state pulses 250 are chosen to have pulse widths, $T_{Pss} > \frac{1}{2}T_R$, so as to not overly reinforce the resonant oscillation. Preferably the steady state pulse should be longer than $T_R$.

In a preferred embodiment of the present invention, a thermally actuated drop emitter is operated by applying an electrical pulse to the electroresistive means during every period $T_C$, of a drop emission clock. If the application data calls for a drop emission, a controller directs use of a nominal electrical pulse. If no drop is required, the controller directs application of a steady state electrical pulse.

In another preferred embodiment of the present invention, the steady state electrical pulses are applied only when needed to establish or maintain the steady state thermal condition. To operate this embodiment, a time to reach the steady state thermal condition is determined in units of the number of drop emission clock periods, $N_{SS}$. That is, the time to reach thermal stability is $N_{SS}\ T_C$. This can be determined by monitoring emitted drop volume and velocity following the application of an increasing number of steady state pulses. Alternately, an increasing number of drops in a sequence can be emitted and observed until it is found how long a sequence $N_{SS}$, is necessary to reliably reach the nominal drop volume. Or, the actual deflection position of an actuator could be observed to identify the number of drops or steady state pulses, $N_{SS}$, needed to achieve the steady state thermal condition.

Steady state pulses are not needed to maintain the steady state thermal condition if no further drop emissions are required for at least $N_{SS}$ clock periods. Some energy can be saved therefore by not applying steady state pulses when it can be anticipated that a long period of no-drop emission will occur, such as at the end of an ink jet carriage scan or during large areas of white image space. Conversely, if the emitter has been inactive for a long period, then a series of steady state pulses may be needed to establish the steady state thermal condition prior to beginning the drop-on-demand sequence of drop emissions.

Figure 13:
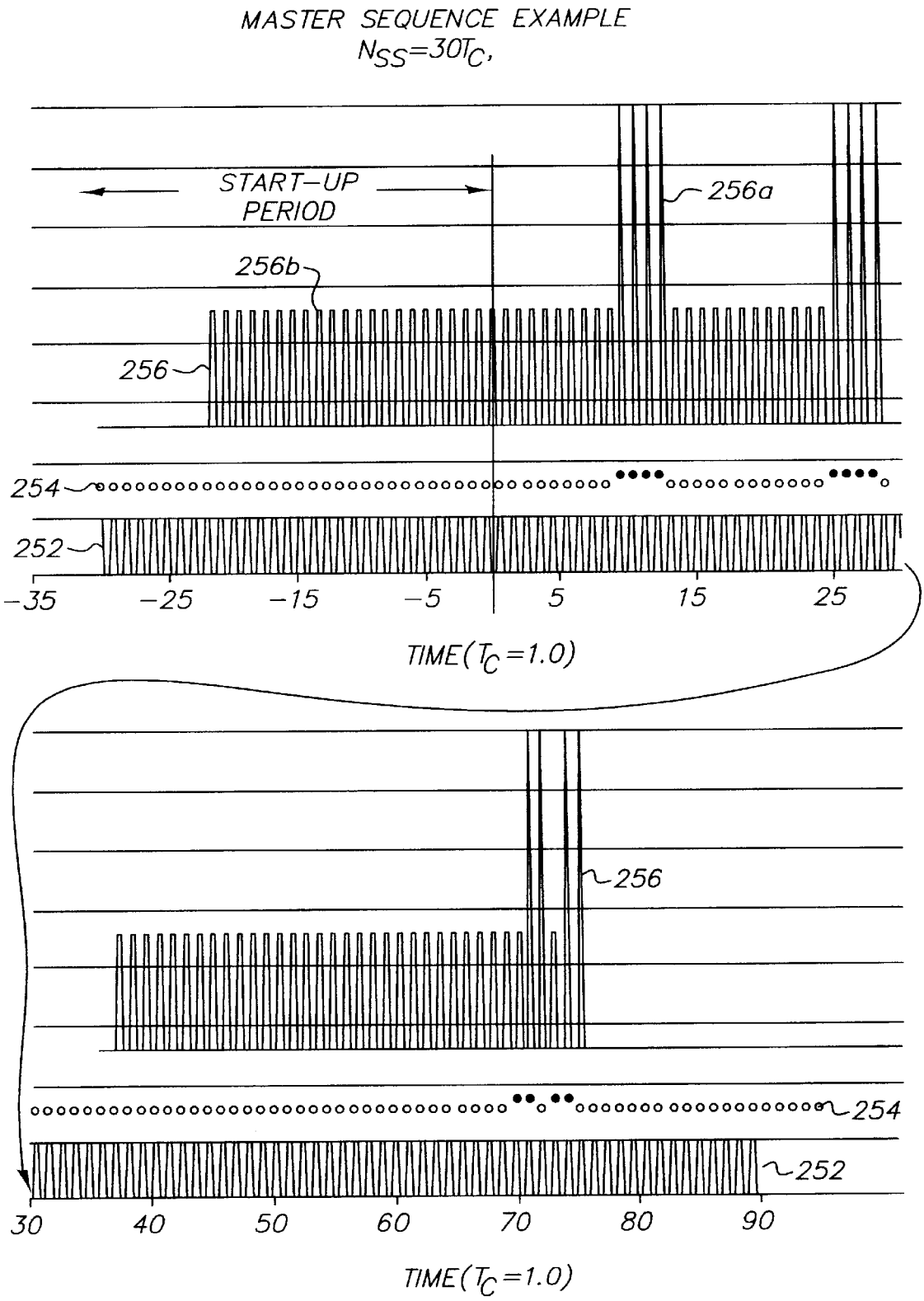
FIG. 13 illustrates a time sequence depicting a drop emitter according to the present invention.

FIG. 13 illustrates some of the preferred embodiments of the present invention. In this illustration, 120 clock periods, $T_C$, of a drop emission clock are indicated by signal 252 on the time axis. Thirty of the clock periods are shown as occurring before zero and 90 afterwards. In this example, it is assumed that $N_{SS}$, the number of periods required to establish steady state, is 30. The commands to emit drops from an application, such as image data for an ink jet printer, are organized by a controller into a master sequence 254 of commands to either emit a drop or not emit a drop during each clock period, $T_C$. The master sequence 254 is symbolized in FIG. 13 by the filled and unfilled dots above each clock period.

As each clock period is reached, the controller causes a source of electrical pulses to apply a nominal pulse 256*a* for every period designated an emit-drop period. These nominal pulses can be seen in the electrical signal 256 of FIG. 13 that is applied to the electroresistive means of a drop emitter.

If the master sequence 254 calls for a no-drop period then a steady state pulse 256*b* is applied unless it is not needed to maintain or establish the steady state thermal condition. The controller examines the master sequence for $N_{SS}$ periods following the present period to determine if any emit-drop periods are present. If so, a steady state pulse is applied. If not, then no pulse may be applied to save energy. In FIG. 13 this condition pertains for the clock periods 29–35 and then for those above period 71. The master sequence ends at 90, and so, after emitting a drop at period 71, the controller determines that the emitter will not need to fire again.

The application of pulses during the clock periods when they are not needed for steady state thermal control is optional for the present invention. There may be other system reasons for applying pulses during these times, to maintain ink temperature or overall emitter device temperature, for example.

In FIG. 13, the 30 no-drop clock periods prior to zero are inserted to perform a preferred embodiment of the invention. The controller inserts $N_{SS}$ no-drop clock periods at the beginning of a new master sequence when it receives a command that a start-up condition is applicable. The extra no-drop periods are inserted so that the emitter may be brought to the steady state thermal condition prior to the first emit command in the application data stream. In the example of FIG. 13, where $N_{SS}$=30, the controller detects an emit-drop clock period at number 9 and so begins applying steady state pulses at number −20, during the start-up period.

The start-up period of electrical pulsing could be combined with drop emission into a maintenance station by using some or all nominal pulses instead of steady state pulses if desired. For the present invention, it is intended that the steady state thermal condition be established for the emission of nominal drops on demand. This condition can be achieved by applying either nominal pulses or steady state pulses as long as drops emitted during operation have an acceptable destination, either the application receiver location or a proper waste receptacle.

The present invention may be applied to configurations of liquid drop emitters other than those herein illustrated and discussed. For example, the liquid emitter may be co-fabricated with other microelectronic devices and structures. In particular, the controller and electrical pulse source means employed by the present invention may be microelectronically integrated with liquid drop emitter units and arrays of emitter units.

Further, while much of the foregoing description was directed to a single drop emitter, it should be understood that the present invention is applicable to arrays and assemblies of multiple drop emitter units.

From the foregoing, it will be seen that this invention is one well adapted to obtain all of the ends and objects. The foregoing description of preferred embodiments of the invention has been presented for purposes of illustration and description. It is not intended to be exhaustive or to limit the invention to the precise form disclosed. Modification and variations are possible and will be recognized by one skilled in the art in light of the above teachings. Such additional embodiments fall within the spirit and scope of the appended claims.

PARTS LIST

10 device microelectronic substrate
12 liquid chamber
12*c* liquid chamber portion at nozzle
14 liquid chamber wall edge at cantilever anchor
16 liquid chamber curved wall portion
20 thermal actuator
20*a* thermal actuator cantilever portion
20*b* thermal actuator anchor portion
20*c* thermal actuator free end portion
22 electroresistive means
26 passivation layer
28 cover plate
30 nozzle
42 electrical input pad
44 electrical input pad
46 electrical connection bond
48 conducting lead
50 drop
60 working fluid
80 support structure
90 buckling thermal actuator
92 backing layer
94 Nozzle
95 electroresistive means
100 ink jet printhead
110 drop emitter unit
200 electrical pulse source
300 Controller
400 image data source
500 Receiver

What is claimed is:

1. A method for operating a liquid drop emitter for emitting liquid drops, said liquid drop emitter comprising a chamber having a nozzle for emitting drops of a liquid filling the chamber, a thermo-mechanical actuator for applying pressure to the liquid, an electrical pulse actuated heater associated with the thermo-mechanical actuator, a source of electrical pulses, and a controller adapted to determine the parameters of the electrical pulses, the method for operating comprising:

(a) determining a nominal electrical pulse having an energy $E_0$, wherein said nominal electrical pulse, when applied to the heater with a repetition period of $T_C$, causes the emission of liquid;

(b) determining a steady state electrical pulse having energy $E_0$, a steady state pulse duration $T_{Pss}$, wherein said steady state electrical pulse, when applied to the heater, does not cause the emission or weeping of the liquid from the nozzle; and (c) applying to the heater during every period of time $T_C$, a nominal electrical pulse to emit liquid, or a steady state electrical pulse, in order to maintain a steady state thermal condition.

2. The method of claim 1 wherein the liquid drop emitter is a drop-on-demand ink jet printhead and the liquid is an ink for printing image data.

3. The method of claim 1 wherein the heater comprises an electroresistive element.

4. The method of claim 3 wherein the steady state electrical pulse is comprised of subpulses, none of which cause liquid emission or weeping when applied to the electroresistive element.

5. The method of claim 1 wherein the steady state pulse duration $T_{Pss}$, is substantially equal to the clock period $T_C$.

6. The method of claim 1 wherein the thermo-mechanical actuator exhibits a time constant $T_I$, for reaching internal thermal equilibrium, where $T_C<5T_I$, and using a smallest value of the steady state pulse duration which will not cause the emission or weeping of the liquid from the nozzle.

7. The method of claim 1 wherein the thermo-mechanical actuator is configured as a cantilever with a free end moveable within the chamber and which exhibits a damped resonant oscillation of fundamental period $T_R$.

8. The method of claim 7 wherein the nominal electrical pulse has pulse duration $T_{P0}$, $T_{P0}<\frac{1}{4}T_R$, and the steady state pulse duration $T_{Pss}>\frac{1}{2}T_R$.

9. The method of claim 1 wherein the thermo-mechanical actuator is configured as a buckling plate forming at least a portion of a wall of the chamber.

10. A liquid drop emitter for emitting a liquid drops, said liquid drop emitter comprising:

a chamber, filled with a liquid, having a nozzle for emitting drops of the liquid;

a thermo-mechanical actuator for applying pressure to the liquid at the nozzle;

a heater associated with the thermo-mechanical actuator and responsive to electrical pulses;

a source of electrical pulses; and a controller adapted to determine parameters of the electrical pulses according to the method set forth in claim 1.

11. A method for operating a liquid drop emitter for emitting sequences of drops, said liquid drop emitter comprising a chamber having a nozzle for emitting drops of a liquid filling the chamber, a thermo-mechanical actuator for applying pressure to the liquid, a heater associated with the thermo-mechanical actuator and responsive to electrical pulses, a source of electrical pulses, and a controller adapted to determine the parameters of the electrical pulses and generating clock signals, the method for operating comprising:

(a) generating a clock, having clock period $T_C$for organizing the application of electrical pulses so that at least one drop, or no drop, is emitted per clock period;

(b) determining a nominal electrical pulse having a nominal energy $E_0$ and a nominal pulse duration $T_{P0}$, wherein said nominal electrical pulse, when applied to the heater with a repetition period of $T_C$, causes the emission of at least one drop;

(c) determining a steady state electrical pulse having energy $E_0$, a steady state pulse duration, $T_{Pss}$, wherein said steady state electrical pulse, when applied to the heater, does not cause the emission or weeping of the liquid from the nozzle;

(d) determining a number of clock periods, $N_{SS}$, during which the thermo-mechanical actuator reaches a steady state thermal condition when an average power, $P_{AVE}=E_0/T_C$, is applied to the heater;

(e) receiving a command to emit a sequence of drops, said command organized as a master sequence of clock periods designated as either an emit-drop clock period or a no-drop clock period;

(f) applying to the heater a nominal electrical pulse during every emit-drop clock period; and (g) applying to the heater a steady state electrical pulse during every no-drop clock period that is followed in the master sequence by an emit-drop period within $N_{SS}$ clock periods in the master sequence.

12. The method of claim 11 wherein the heater comprises an electroresistive element.

13. The method of claim 11 wherein the liquid drop emitter is a drop-on-demand ink jet printhead and the liquid is an ink for printing image data.

14. The method of claim 11 wherein the steady state electrical pulse is comprised of subpulses, none of which cause liquid emission or weeping when applied to the heater.

15. The method of claim 11 wherein the steady state pulse duration $T_{Pss}$, is substantially equal to the clock period $T_C$.

16. The method of claim 11 wherein the thermo-mechanical actuator exhibits a time constant $T_I$, for reaching internal thermal equilibrium, where $T_C<5T_I$, and using a smallest value of the steady state pulse duration which will not cause the emission or weeping of the liquid from the nozzle.

17. The method of claim 11 wherein the thermo-mechanical actuator is configured as a cantilever with a free end moveable within the chamber and exhibiting a damped resonant oscillation of fundamental period $T_R$, and the nominal pulse duration $T_{P0}<T_R$.

18. The method of claim 17 wherein the nominal pulse duration $T_{P0}<\frac{1}{4}T_R$, and the steady state pulse duration $T_{Pss}>\frac{1}{2}T_R$.

19. The method of claim 11 wherein the thermo-mechanical actuator is configured as a buckling plate forming at least a portion of a wall of the chamber.

20. The method of claim 11 wherein the receiving step (e) further comprises receiving a start-up command and inserting at least $N_{SS}$ clock periods, designated as either no-drop clock periods or emit-drop clock periods, at the beginning of the master sequence of clock periods.

21. A liquid drop emitter for emitting sequences of liquid drops, said liquid drop emitter comprising:

a chamber having a nozzle for emitting drops of a liquid filling the chamber;

a thermo-mechanical actuator for applying pressure to the liquid;

a heater associated with the thermo-mechanical actuator and responsive to electrical pulses;

a source of electrical pulses; and a controller adapted to determine the parameters of the electrical pulses and generating clock signals according to the method set forth in claim 11.

* * * * *